United States Patent [19]

Uda et al.

[11] Patent Number: 4,637,238

[45] Date of Patent: Jan. 20, 1987

[54] FOLDING KEY FOR VEHICLES

[75] Inventors: Youichi Uda, Miyazaki; Seiya Matsushima, Sakado; Kazuhiko Saito, Kodaira; Shoji Yamamoto, Tokyo; Kazuhiro Murakami, Kamifukuoka, all of Japan

[73] Assignees: Honda Giken Kogyo Kabushiki Kaisha, Tokyo; Honda Lock Manufacturing Co., Ltd., Miyazaki, both of Japan

[21] Appl. No.: 812,292

[22] Filed: Dec. 23, 1985

[30] Foreign Application Priority Data

Dec. 28, 1984 [JP] Japan ..... 59-196861[U]
Feb. 20, 1985 [JP] Japan ..... 60-23780[U]

[51] Int. Cl.[4] ..... A44B 15/00

[52] U.S. Cl. ..... 70/456 R; 70/408; 74/527

[58] Field of Search ..... 70/408, 395, 456 M, 70/396; 74/527

[56] References Cited

U.S. PATENT DOCUMENTS 3,027,606 4/1962 Nicklas ..... 74/527
3,142,508 7/1964 McHugh ..... 74/527
3,618,346 11/1971 Humphrey ..... 70/456
4,379,394 4/1983 Toyoda ..... 70/456 R
4,516,000 5/1985 Ryberg ..... 70/408
4,524,594 6/1985 Bascon ..... 70/456

FOREIGN PATENT DOCUMENTS 1919977 5/1970 Fed. Rep. of Germany ..... 70/395
11-12592 5/1936 Japan .

*Primary Examiner*—Henry E. Raduazo
*Attorney, Agent, or Firm*—Frishauf, Holtz, Goodman & Woodward

[57] ABSTRACT

A folding key for vehicles, in which a key body is pivotally mounted in a dished cap so as to be capable of pivoting with respect to the cap. The key body has a pivot portion which is directly supported by a bearing bore formed in the cap, or which is clamped and supported between a first bearing portion provided in a bottom surface of a recess in the cap and a second bearing portion provided in a support member fitted in the recess in the cap. In the latter case, a resilient tongue is resiliently engaged with an inward end of the key body to retain the same. The cap has formed therein a cut-out with which the key body is engaged upon ultimate levelling of the key body. Preferably, the cut-out is formed in a portion of a peripheral edge of the cap, which is located at a rear of the peripheral edge with reference to an advance direction of the vehicle.

12 Claims, 15 Drawing Figures

FOLDING KEY FOR VEHICLES

BACKGROUND OF THE INVENTION

The present invention relates to a folding key for vehicles, for turning on and off an ignition switch or the like of the vehicle and, more particularly, to a folding key suitable for use in motor tricycles and four-wheeled buggy vehicles for travelling on a waste or rugged land.

A folding key for turning on and off an ignition switch provided on a body outer surface of a vehicle of the kinds described above is known from Japanese Utility Model Publication No. 36-12592, for example. The folding key comprises a key body, and a cap serving also as a knob and attached to a base of the key body. The key body has a base end pivotally mounted on the cap so as to be capable of being raised and levelled with respect thereto to allow the cap to cover a keyhole, in order to prevent dust and rainwater from entering the keyhole.

With such publicly known folding key, however, disadvantages have been encountered that since a coil spring for retaining the key in a raised position is provided in the cap, the cap has a thickness increased to provide a space for receiving the spring and, accordingly, it would be difficult to accommodate the key in a keeping location and it would be inconvenient to carry the key, and that if the key is attached to a buggy vehicle or the like travelling on a rugged land, dust and sand would adhere to the spring, the spring seat, etc. to prevent the key body from being raised and levelled smoothly.

SUMMARY OF THE INVENTION

An object of the present invention is to provide a folding key for vehicles, in which a cap has a thickness reduced to facilitate the accommodation of the key in a keeping location and to facilitate the carrying of the key.

Another object of the present invention is to provide a folding key for vehicles, which is arranged and disposed so as not to allow dust, rainwater and the like to easily enter from the outside.

A still further object of the present invention is to provide a folding key for vehicles, in which should dust, sand or the like enter, it would be possible to smoothly raise and level a key body.

According to a first aspect of the present invention, there is provided a folding key for vehicles, comprising: a dished cap having a cut-out formed in a portion of a peripheral edge of the cap; a bearing portion provided in the cap; and a key body having one end thereof supported by the bearing portion and capable of pivoting with respect to the cap about the bearing portion, the key body being engageable with the cut-out when the key body pivots ultimately; the cap being arranged on the vehicle so as to allow the key body to be levelled in parallel to an advance direction of the vehicle; and the portion of the peripheral edge of the cap, in which the cut-out is formed, being located at a rear of the peripheral edge with reference to the advance direction of the vehicle.

According to a second aspect of the present invention, a cap has a recess which opens at one end face of the cap. A first bearing portion is provided in a bottom surface of the recess. A support member is fitted in the recess and has an opening opposed to the bottom surface of the recess and an inner surface opposed to the first bearing portion. A second bearing portion opposed to the first bearing portion is provided in the inner surface at opposite sides of the opening. A key body extends through the opening in the support member and has a pivot portion pivotally clamped and supported between the first and second bearing portions. A resilient member is disposed between the bottom surface of the recess in the cap and the opening in the support member and is resiliently engaged with an inward end of the key body.

In the second aspect described above, a cut-out is formed in a portion of a peripheral edge of the cap, and the key body is engaged with the cut-out when ultimately levelled with respect to the cap. The cap is arranged so as to allow the key body to be levelled in parallel to an advance direction of the vehicle. The portion of the peripheral edge of the cap, in which the cut-out is formed, is located at a rear of the peripheral edge with reference to the advance direction of the vehicle.

The above and other objects, features and advantages of the invention will become apparent from the following detailed description with reference to the accompanying drawings.

DETAILED DESCRIPTION

Figure 1:
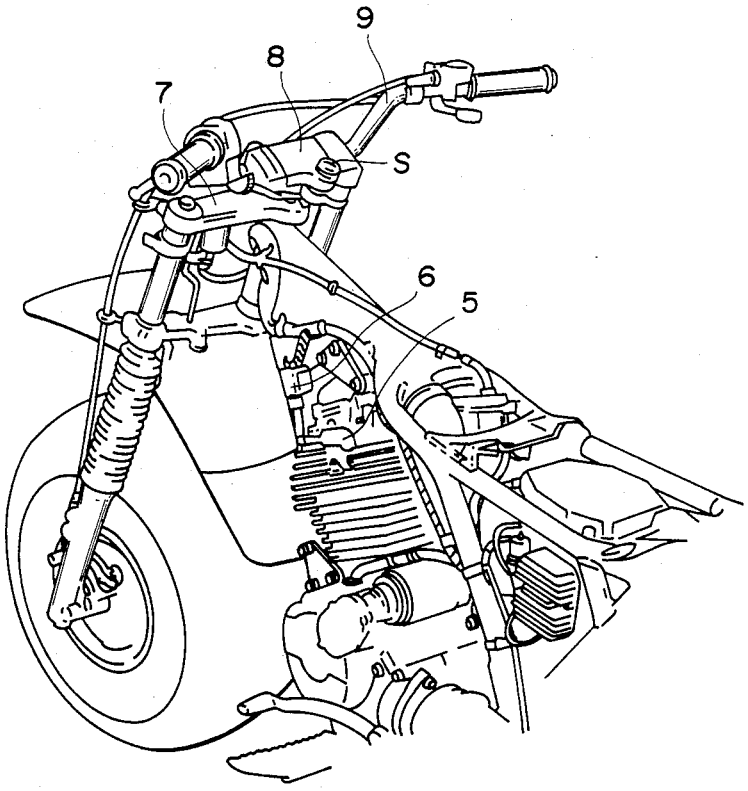
FIG. 1 is a partially broken-away, perspective view showing a motor tricycle of a buggy type, in which a folding key for vehicles in accordance with the present invention is utilized as an ignition switch.

The invention will now be described with reference to the drawings showing embodiments thereof. Like reference numerals are used throughout the drawings to designate identical or similar elements and parts.

FIG. 1 shows a motor tricyle of a buggy type illustrated by way of an example. A switch S forming a part of an ignition switch mechanism which includes a spark plug cap 5, an ignition coil 6, etc. are incorporated in an upper surface of an upholder 8 which is provided in a slightly rearwardly inclined manner at a central portion of a handlebar 9 above a top bridge 7.

Figure 2:
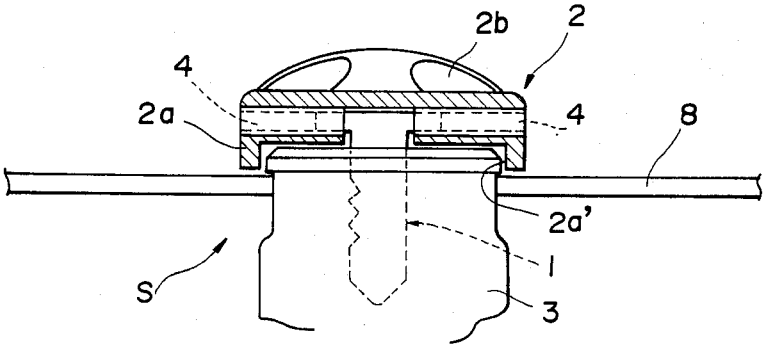
FIG. 2 is a longitudinal cross-sectional view showing a folding key for vehicles in accordance with a first embodiment of the present invention with the key being fitted in a key cylinder of the vehicle.

The switch S includes, as shown in FIG. 2 illustrating a first embodiment of the invention, for example, a folding key of the invention which comprises a cap 2 in the form of a dish serving also as a knob, a key body 1 pivotally mounted to the cap 2 at a base thereof, and a key cylinder 3 at the side of the upholder 8 into which the key body 1 is to be inserted. The cap 2 comprises a cylindrical base 2*a* having a circular recess 2*a'* which opens at one end face of the base 2*a* and has such a diameter and depth as to completely cover a head of the key cylinder 3, and a knob portion 2*b* which is integrally formed on an outer surface of the other end of the base 2*a* and is adapted to be held by a rider for angularly moving the key body 1.

Figure 3:
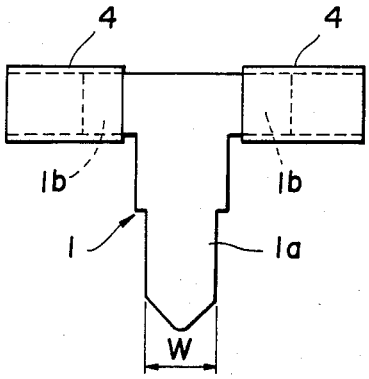
FIG. 3 is a front elevational view showing a key body of the key illustrated in FIG. 2.

As best shown in FIG. 3, the key body 1 is formed into a generally T-shape, and comprises an insert portion 1*a*, and a pair of pivot portions 1*b* and 1*b* extending oppositely and laterally from one end of the insert portion 1*a*, with bushes 4 and 4 made of brass, for example, being fitted on the pivot portions 1*b* and 1*b*, respectively. The cap 2 is formed by an integral molding of synthetic resin. A pair of bearing bores 2*c* and 2*c* (FIG. 5) having a rectangular cross-section, accurately speaking, a generally square cross-section are formed within the cap 2 and extend through a diametrical center thereof in a diametrically opposed manner. The pivot portions 1*b* and 1*b* of the key body 1 having fitted thereon the respective bushes 4 and 4 are pivotally fitted in the bearing bores 2*c* and 2*c*, respectively. The bearing bores 2*c* and 2*c*, hence, the pivot portions 1*b* and 1*b* of the key body 1 extend in the same direction as the extending direction of the generally sector-shaped knob portion 2*b* which is integrally provided on an outer surface of the cap 2 and projected therefrom. Accordingly, the key body 1 pivots in a plane perpendicular to the extending direction of the knob portion 2*b*.

Figure 4:
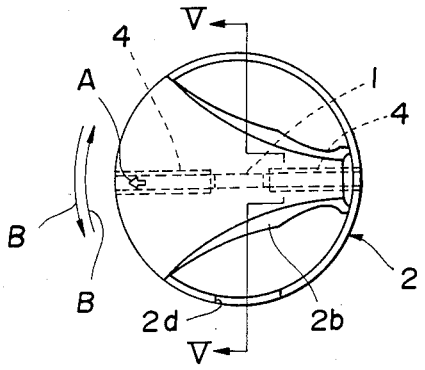
FIG. 4 is a top plan view of the key shown in FIG. 2.

A cut-out 2*d* (FIG. 4) having a rectangular cross-section and having a width slightly greater than the width W of the insert portion 1*a* of the key body 1 is formed at a portion of a peripheral edge of the cylindrical base 2*a* of the cap, which portion corresponds to the levelling direction of the key body 1, so that when levelled, the insert portion 1*a* of the key body 1 is received in the cut-out 2*d*. That is, in the illustrated embodiment, the cut-out 2*d* is provided in the portion of the peripheral edge which is located perpendicularly to the direction of an arrow A indicating the front of a vehicle body when the key body 1 is inserted into the key cylinder 3.

By the provision of the above-described cut-out 2*d* and bearing bores 2*c* and 2*c* having the generally square cross-section, the insert portion 1*a* of the key body 1 is capable of pivoting through approximately 90 degrees about the pivot portions 1*b* and 1*b*, to thereby enable the key to be folded.

Figure 5:
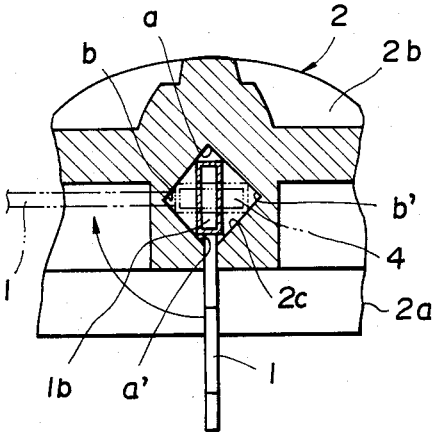
FIG. 5 is a partially broken-away, cross-sectional view taken along the line V—V in FIG. 4.

In use of the folding key arranged as described above, the key body 1 is raised at right angles with respect to the cap 2 as shown by the solid line in FIG. 5, and the insert portion 1*a* is inserted into a keyhole, not shown, of the key cylinder 3 until the cap 2 is fitted on a portion of the head of the key cylinder 3 which extends upwardly from the upholder 8. Subsequently, the rider holds the knob portion 2*b* of the cap 2 and angularly moves the cap 2 in the directions indicated by arrows B in FIG. 4 to turn on and off the ignition switch. On the other hand, when the key is not used, the key is pulled out of the key cylinder 3 and, subsequently, the insert portion 1*a* of the key body is levelled in a predetermined direction toward the cut-out 2*d* to thereby be engaged within the cut-out 2*d*, so that the key is folded. Here, as shown in FIG. 5, since each of the bearing bores 2*c* and 2*c* is formed into a rectangular cross-section having four corners (a, a', b, b'), clicking effects are obtained upon raising and levelling of the key body, and it is ensured that the key body is retained in predetermined raised positions (a, a') and predetermined levelled positions (b, b').

Figure 6:
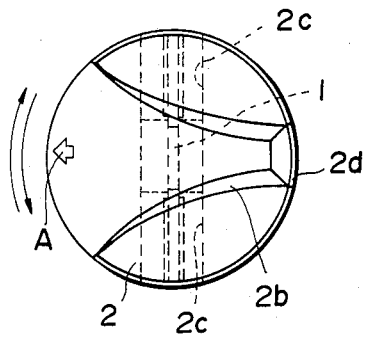
FIG. 6 is a top plan view showing a folding key in accordance with a second embodiment of the present invention.
Figure 7:
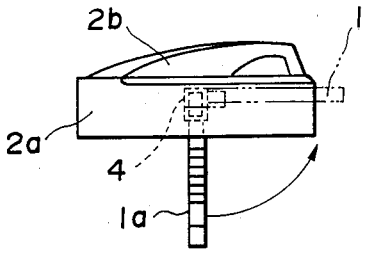
FIG. 7 is a side elevational view of the key shown in FIG. 6.
Figure 8:
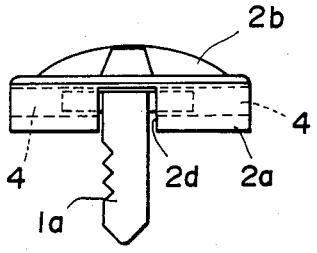
FIG. 8 is a rear view of the key shown in FIG. 6.

FIGS. 6 through 8 show a second embodiment of the invention, which is identical with the above-described first embodiment in that a cap 2 is mounted on the upholder 8 (FIG. 1) such that a sector-shaped knob portion 2*b* extends in the advance direction of the vehicle, but is different from the first embodiment in that bearing bores 2*c* and 2*c* in the cap 2 and pivot portions 1*b* and 1*b* of a key body 1 extend perpendicularly to the extending direction of the knob portion 2*b* and, accordingly, the key body 1 is capable of being levelled in the same direction as the extending direction of the knob portion 2*b*, i.e., in parallel to the advance direction of the vehicle, and a cut-out 2*d* is formed in a rear edge portion of a cylindrical base 2*a* of the cap 2 which is located rearwardly with reference to the advance direction of the vehicle. Preferably, the cut-out 2*d* is so arranged as to be located just at the back with reference to the advance direction of the vehicle when the knob portion 2*b* is angularly moved to a position where the ignition switch is turned on. Inasmuch as the entire switch S including the key is mounted on the rearwardly inclined upper surface of the upholder 8 of the vehicle body, it would be difficult for rainwater or the like to enter the interior of the key through the cut-out 2*d* formed in the rear portion of the cap 2, but rainwater or the like having entered the interior would tend to flow out through the cut-out 2*d*.

Figure 9:
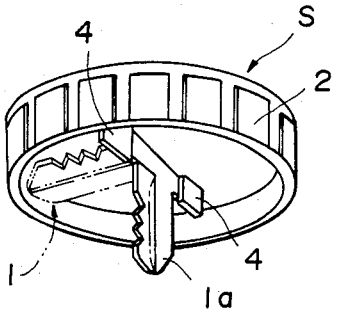
FIG. 9 is a perspective view showing a folding key in accordance with a third embodiment of the present invention, with some parts being omitted.
Figure 10:
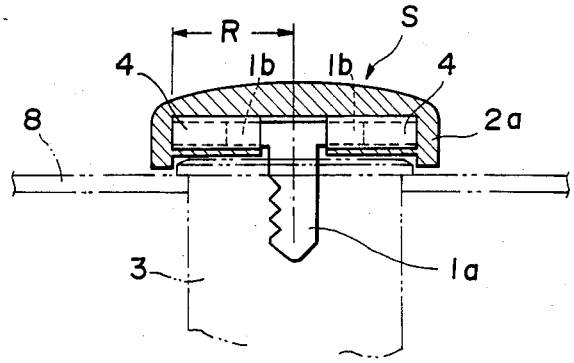
FIG. 10 is a longitudinal cross-sectional view of the key shown in FIG. 9.
Figure 11:
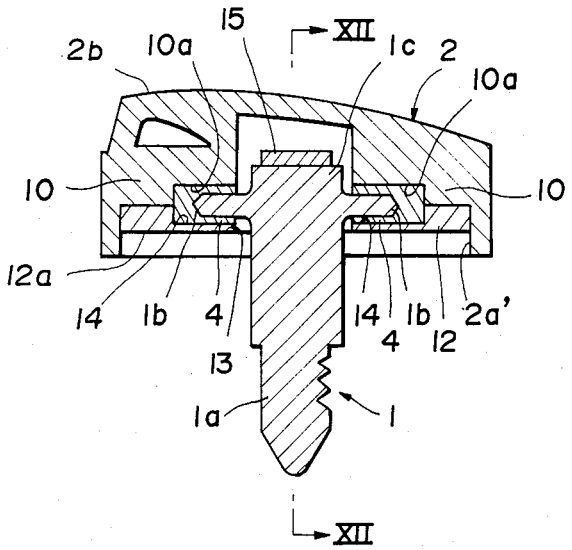
FIG. 11 is a longitudinal cross-sectional view showing a folding key in accordance with a fourth embodiment of the present invention.
Figure 12:
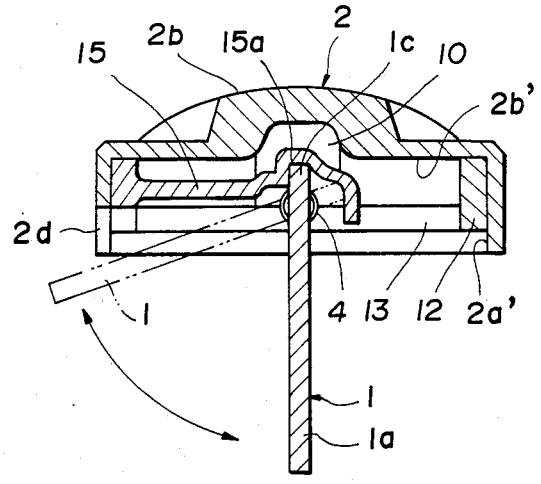
FIG. 12 is a cross-sectional view taken along the line XII—XII in FIG. 11.
Figure 13:
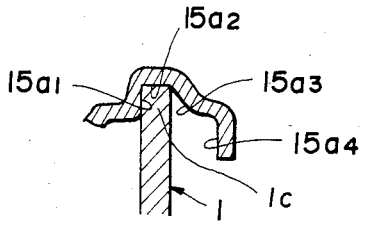
FIG. 13 is an enlarged fragmentary view showing a portion of FIG. 12 in which a key body is engaged with a resilient tongue.
Figure 14:
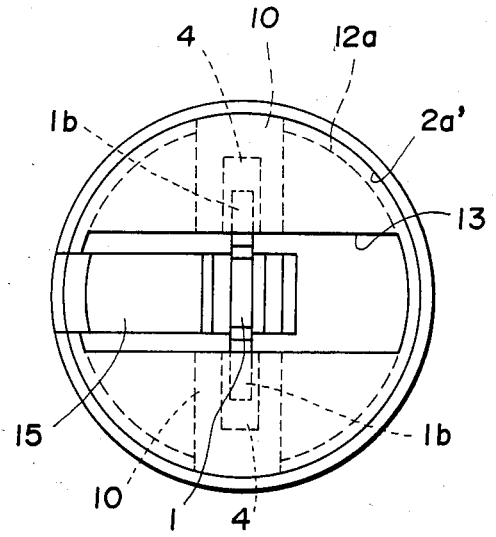
FIG. 14 is a bottom plan view of the key shown in FIG. 11.
Figure 15:
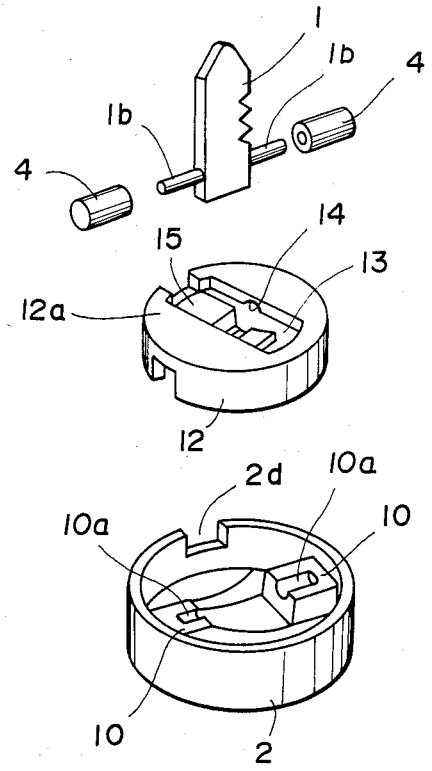
FIG. 15 is an exploded perspective view showing the key illustrated in FIG. 11.

FIGS. 9 and 10 show a third embodiment of the invention, which is different from the above-described first and second embodiments only in that an insert portion 1*a* of a key body 1 has a length less than an inside diameter R of a cap 2 and the insert portion 1*a* is completely accommodated within the cap 2 when the key body 1 is levelled.

Accordingly, it is unnecessary for the third embodiment to particularly provide a cut-out 2*d* in a peripheral edge portion of a cap 2, and the third embodiment is advantageous in that such troublesomeness is dissolved as to take into consideration the location of the provision of the cut-out 2*d* so as not to allow rainwater or the like to enter, and in that since the head of the key cylinder 3 is substantially sealingly covered by the covering cap 2, rainwater or the like is prevented from entering.

FIGS. 11 through 15 show a fourth embodiment of the invention. In contradistinction to each of the above-described embodiments in which the pivot portions 1*b* and 1*b* of the key body 1 are respectively fitted in the bearing bores 2*c* and 2*c* formed directly within the cap 2, the fourth embodiment is arranged such that pivot portions 1*b* and 1*b* of a key body 1 is supported by a cap 2 through a separate support member and a resilient tongue. Specifically, a pair of bearing sections 10 and 10 opposed to each other diametrically of the cap 2 are integrally formed on a bottom surface of a circular recess 2*a'* in the cap 2 in a fashion projected from the bottom surface, and the pivot portions 1*b* and 1*b* of the key body 1 are respectively fitted pivotally in diametrically opposed grooves 10*a* and 10*a* formed respectively in the bearing sections 10 and 10, through bushes 4 and 4. A cylindrical support member 12 is fitted in the circular recess 2*a'* in the cap 2 with one circular open end face of the support member 12 abutting against an underside 2*b'* of a knob portion 2*b* (bottom surface of the recess 2*a'*). *The support member 12 has the other end face 12a* forming a bottom wall in which an elongated opening 13 is formed substantially at a center of the bottom wall. The key body 1 has an insert portion 1*a* extending through the opening 13, and the pivot portions 1*b* and 1*b* are respectively supported in bearing recesses 14 and 14 in the support member 12 which are formed in an inner surface of the bottom wall 12*a* and respectively open at respective central portions of side edges of the opening 13. Thus, the pivot portions 1*b* and 1*b* of the key body 1 are respectively clamped pivotally between the bearing recesses 14 and 14 of the support member 12 and the bearing sections 10 and 10 of the cap 2 through the bushes 4 and 4 which are fitted on the pivot portions 1*b* and 1*b*, respectively. Furthermore, a resilient tongue 15 has one end thereof fixedly connected to an inner peripheral surface of the support member 12 by means of weld or the like and extends diametrically into the circular recess 2*a'* in the cap 2 to a position slightly beyond the diametrical center. The key body 1 has an inward end 1*c* thereof which slidably and resiliently abuts against an outwardly facing concave surface 15*a* at the free end of the resilient tongue 15. As clearly shown in FIG. 13, the concave surface 15*a* is comprised of a vertical surface section $15a_1$ facing to a side surface of the key body 1 toward the levelling direction thereof, a horizontal surface section $15a_2$ formed adjacent the vertical surface section $15a_1$ and extending toward the free end of the resilient tongue 15, an inclined surface section $15a_3$ extending obliquely outwardly, and a vertical surface section $15a_4$, which surface sections are continuous to each other. When the key body 1 is raised, the side surface of the inward end 1*c* and an end face of the inward end 1*c* of the key body 1 simultaneously abut against the vertical surface section $15a_1$ and the horizontal surface section $15a_2$, respectively, to thereby stably retain the key body 1 in a raised portion. As the key body 1 is angularly moved from the raised position toward a levelled position, the inward end 1*c* slides along the inclined surface section $15a_3$ and, as the key body 1 reaches the levelled position where it is received within the cut-out 2*d* in the cap 2, the inward end 1*c* abuts against the vertical surface section $15a_4$, to thereby stably retain the key body 1 in the levelled position.

Similarly to the second embodiment, the fourth embodiment has the cut-out 2*d* provided in a rearward edge portion of the cap 2 corresponding to the rear of the vehicle, and can provide advantages similar to those discribed above.

According to the arrangement of the fourth embodiment, it is possible to reduce the thickness of the cap 2, and it would be possible to pivotally support the key body by the support member 12 and the resilient tongue 9 in a smooth manner for a long time without any hindrance to the levelling movement of the key body even if the support member 12 and the resilient tongue 9 are contaminated with dust.

What is claimed is:

1. A folding key for a vehicle having a key cylinder, comprising:

a dished cap having an outer end surface, an outer peripheral surface axially extending from a periphery of said outer end surface and forming a peripheral edge, a cut-out formed in a portion of said peripheral edge of said outer peripheral surface, and an inner end surface having a recess formed therein;

a bearing portion provided in said cap; and a key body having one end thereof supported by said bearing portion and being pivotable with respect to said cap about said bearing portion, said key body being engageable with said cut-out when said key body pivots ultimately;

said cap being arranged on the vehicle so as to allow said key body to be levelled substantially in parallel to an advance direction of the vehicle;

said cap being arranged on the vehicle in a manner such that part of said key cylinder is fitted in said recess of said inner end surface of said cap; and said portion of the peripheral edge of said cap, in which said cut-out is formed, being located rearwardly of the peripheral edge with reference to the advance direction of the vehicle.

2. A folding key as defined in claim 1, wherein said bearing portion comprises a pair of bearing bores formed in said cap per se and having a generally rectangular cross-section, said key body having a pair of pivot portions having a generally rectangular cross-section and extending oppositely and laterally from said one end of said key body, said pivot portions being respectively engaged with said bearing bores so as to cooperate therewith to perform a clicking motion as said key body pivots.

3. A folding key as defined in claim 2, wherein said cap has a knob portion provided on said outer end surface of said cap, said knob portion projecting from said outer end surface of said cap.

4. A folding key as defined in claim 3, wherein said bearing bores and said pivot portions of said key body extend substantially perpendicularly to an extending direction of said knob portion.

5. A folding key for a vehicle, comprising:

a dished cap having a recess which opens at one end face of said dished cap, said recess having a bottom surface;

a first bearing portion provided in the bottom surface of said recess;

a support member fitted in said recess of said dished cap and having an opening opposed to the bottom surface of said recess and an inner surface opposed to said first bearing portion;

a second bearing portion provided in the inner surface of said support member at opposite sides of said opening therein in opposed relation to said first bearing portion;

a key body extending through the opening in said support member and having a pivot portion pivotally clamped and supported between said first and second bearing portions for rotation about an axis thereof; and a resilient member disposed between the bottom surface of said recess in said dished cap and the opening in said support member and resiliently engaged with an inward end of said key body;

said first bearing portion comprising a pair of bearing sections formed on the bottom surface of said recess and projecting therefrom, said pair of bearing sections respectively having formed therein first grooves opposed to each other;

said second bearing portion comprising a pair of second grooves respectively opposed to said first grooves;

said key body comprising a pair of pivot portions each pivotally fitted and supported between a corresponding one of said first grooves and a corresponding one of said second grooves; and said resilient member having one end thereof fixedly secured to said support member, and a free end portion thereof resiliently engaged with the inward end of said key body.

6. A folding key as defined in claim 5, wherein said free end portion of said resilient member has an outward surface which comprises a vertical surface section abutting against a side surface of said inward end of said key body, and a horizontal surface section abutting against an end face of said inward end when said key body is raised.

7. A folding key as defined in claim 6, wherein said free end portion of said resilient member has an outward surface which comprises an inclined surface section along which said inward end of said key body slides upon angular movement of said key body to a levelled position, and a second vertical surface section abutting against the end face of said inward end when said key body is in said levelled position.

8. A folding key as defined in claim 5, wherein said dished cap has an outer end surface, said dished cap comprising a knob portion integrally provided on said outer end surface of said cap, said knob portion projecting from said outer end surface of said cap.

9. A folding key as defined in claim 5, wherein said free end portion of said resilient member has an outward surface which comprises an inclined surface section along which said inward end of said key body slides upon angular movement of said key body to a levelled position, and a second vertical surface section abutting against the end face of said inward end when said key body is in said levelled position.

10. A folding key for a vehicle having a key cylinder, comprising:

a dished cap having an outer end surface, an outer peripheral surface axially extending from a periphery of said outer end surface and forming a peripheral edge, a cut-out formed in a portion of said peripheral edge of said outer peripheral surface, and a recess formed in an inner surface of said dished cap and which opens at one end face of said dished cap, said recess having a bottom surface;

a first bearing portion provided in the bottom surface of said recess;

a support member fitted in said recess of said cap and having an opening opposed to the bottom surface of said recess and an inner surface opposed to said first bearing portion;

a second bearing portion provided in the inner surface of said support member at opposite sides of said opening therein in opposed relation to said first bearing portion;

a key body extending through the opening in said support member and having a pivot portion pivotally clamped and supported between said first and second bearing portions for rotation about an axis thereof, said key body being engaged with said cut-out when ultimately levelled with respect to said dished cap; and a resilient member disposed between the bottom surface of said recess in said dished cap and the opening in said support member and resiliently engaged with an inward end of said key body;

said dished cap being arranged on the vehicle such that part of said key cylinder is fitted in said recess of said dished cap and so as to allow said key body to pivot substantially in parallel to an advance direction of the vehicle;

said portion of said peripheral edge of said dished cap, in which said cut-out is formed, being located rearwardly of the peripheral edge with reference to the advance direction of the vehicle.

11. A folding key as defined in claim 10, wherein:

said first bearing portion comprises a pair of bearing sections formed on the bottom surface of said recess and projecting therefrom, said pair of bearing sections respectively having formed therein first grooves opposed to each other;

said second bearing portion comprises a pair of second grooves respectively opposed to said first grooves; and said key body comprises a pair of pivot portions each pivotally fitted and supported between a corresponding one of said first grooves and a corresponding one of said second grooves.

12. A folding key as defined in claim 10, wherein said resilient member has one end thereof fixedly secured to said support member, and a free end portion thereof resiliently engaged with the inward end of said key body.

* * * * *